US008066344B2

(12) United States Patent
Ito

(10) Patent No.: US 8,066,344 B2
(45) Date of Patent: Nov. 29, 2011

(54) APPARATUS CAPABLE OF MOUNTING EXPENDABLE CARTRIDGES, METHOD FOR COUNTING CONSUMPTION AMOUNT OF EXPENDABLE CARTRIDGES, AND COMPUTER PROGRAM

(75) Inventor: Ryohei Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 12/455,170

(22) Filed: May 29, 2009

(65) Prior Publication Data

US 2009/0295849 A1 Dec. 3, 2009

(30) Foreign Application Priority Data

May 29, 2008 (JP) ..... 2008-140716

(51) Int. Cl.
*B41J 2/195* (2006.01)

(52) U.S. Cl. ..... 347/7; 347/5
(58) Field of Classification Search ..... 347/5, 7
See application file for complete search history.

(56) References Cited

U.S. PATENT DOCUMENTS 6,676,237 B2 * 1/2004 Kobayashi et al. ..... 347/7

FOREIGN PATENT DOCUMENTS

JP 401020148 A * 1/1989
JP 2006-199041 8/2006
JP 2006-343689 12/2006

* cited by examiner

*Primary Examiner* — Ryan Lepisto
*Assistant Examiner* — Guy Anderson
(74) *Attorney, Agent, or Firm* — Nutter McClennen & Fish LLP; John J. Penny, Jr.; Rory P. Pheiffer

(57) ABSTRACT

Provided is an apparatus capable of mounting an expendable cartridge thereon, including: a consumption amount counting unit that counts up the consumption amount of expendable cartridges in the apparatus when a change is detected for the first time during the continuous operation or the apparatus. The detected change is a residual expendable amount of the expendable cartridge decreasing from a value higher than a predetermined low residual level to a value lower than or equal to the low residual level. The consumption amount of the expendable cartridges is counted up and is detected in a number of different manners, depending on the circumstances surrounding the measured values of the residual expendable amounts and the replacement of the cartridges.

6 Claims, 7 Drawing Sheets

FIRST EMBODIMENT

SECOND EMBODIMENT

APPARATUS CAPABLE OF MOUNTING EXPENDABLE CARTRIDGES, METHOD FOR COUNTING CONSUMPTION AMOUNT OF EXPENDABLE CARTRIDGES, AND COMPUTER PROGRAM

CROSS REFERENCES TO RELATED APPLICATIONS

The present invention contains subject matter related to Japanese Patent Application No. 2008-140716 filed in the Japanese Patent Office on May 29, 2008, the entire contents of which are incorporated herein by reference.

BACKGROUND

1. Technical Field

The invention relates to the replacement of cartridges in an apparatus capable of mounting expendable cartridges thereon, and more particularly, relates to a technique of counting the consumption amount of expendable cartridges.

2. Related Art

One exemplary technique concerning the replacement of expendable cartridges is described in JP-A-2006-199041, for example. According to this technique, when a residual ink amount detected by a residual ink amount sensor is smaller than a predetermined level, users can order a new cartridge with a printed order sheet containing the model number of the ink cartridge.

However, in the related art, sufficient studies have not been conducted with regard to techniques for counting the consumption amount of expendable cartridges.

SUMMARY

An advantage of some aspects of the invention is that it provides a technique capable of correctly counting the consumption amount of expendable cartridges.

The invention aims to solve at least part of the above-described problems and can be actualized as a form or an application described below.

Application 1

An apparatus capable of mounting an expendable cartridge thereon, which includes a consumption amount counting unit that counts up the consumption amount of expendable cartridges in the apparatus when a change is detected for the first time during the continuous operation of the apparatus. The change can be a residual expendable amount of the expendable cartridge decreasing from a value higher than a predetermined low residual level to a value lower than or equal to the low residual level.

According to such a configuration, when the change is detected for the first time, the consumption amount of the expendable cartridges is counted up. Therefore, it is possible to correctly count the consumption amount of the expendable cartridges.

Application 2

The apparatus according to Application 1, wherein the consumption amount counting unit counts up the consumption amount of the expendable cartridges when the change is detected for the first time during the continuous operation of the apparatus.

According to such a configuration, when the residual expendable amount of the expendable cartridges was higher than the low residual level before the apparatus stops its operation and the residual expendable amount is subsequently found to be lower than or equal to the low residual level after the apparatus resumes its operation, the consumption amount of the expendable cartridges is not counted up. Therefore, even when the in-use cartridge is replaced with a cartridge, of which the residual expendable amount is low, during non-operation of the apparatus, it is possible to prevent the consumption amount of the expendable cartridges from being erroneously counted up.

Application 3

The apparatus according to Application 1 or 2, wherein with respect to the respective expendable cartridges mounted on the apparatus, the consumption amount counting unit performs as follows:

(a1) detects whether or not the residual expendable amount is lower than or equal to the low residual level immediately after the apparatus is powered on; and (a2) does not perform the count-up with respect to an expendable cartridge of which the residual expendable amount is lower than or equal to the low residual level immediately after the power-on.

According to such a configuration, the detection as to whether or not the residual expendable amount is lower than or equal to the low residual level is made immediately after the apparatus is powered on. Therefore, the consumption amount of the expendable cartridges can be more accurately counted.

Application 4

The apparatus according to any one of Applications 1 to 3, wherein when any expendable cartridge is replaced during the continuous operation of the apparatus, the consumption amount counting unit performs as follows:

(b1) detects whether or not the residual expendable amount is lower than or equal to the low residual level immediately after the replacement; and (b2) does not perform the count-up with respect to the replaced expendable cartridge when the residual expendable amount immediately after the replacement is lower than or equal to the low residual level.

According to this configuration, the detection as to whether or not the residual expendable amount is lower than or equal to the low residual level is made immediately after the replacement of the cartridge. Therefore, the consumption amount of the expendable cartridges can be more accurately counted.

Application 5

The apparatus according to any one of Applications 1 to 4, wherein the expendable cartridge incorporates therein a sensor capable of detecting the residual expendable amount, and wherein the consumption amount counting unit detects the change using the sensor.

According to such a configuration, the use of the sensor enables the acquisition of the residual expendable amount with high accuracy.

Application 6

The apparatus according to any one of Applications 1 to 5, further comprising a nonvolatile memory for storing information on the consumption amount of the expendable cartridges in the apparatus, wherein the nonvolatile memory stores the accumulative consumption amount of the expendable cartridges in the apparatus.

According to such a configuration, the accumulative consumption amount of the expendable cartridges in the apparatus can be acquired only by reading the contents of the nonvolatile memory in the apparatus.

Application 7

The apparatus according to any one of Applications 1 to 6, further comprising a nonvolatile memory for storing information on the consumption amount of the expendable cartridges in the apparatus, wherein the expendable counting unit has a function of reading the information on the consumption amount from the nonvolatile memory to report the information to an external device, and wherein the nonvolatile memory stores, as the consumption amount information, the increment in the consumption amount of the expendable cartridges from the point in time when the previous report was sent to the external device.

According to such a configuration, the required capacity of the nonvolatile memory in the apparatus can be reduced.

The invention may be embodied in a variety of forms. For example, the invention may be embodied in the form of a method for counting expendable cartridges, an apparatus capable of mounting an expendable cartridge thereon, a computer program for implementing the functions of such a method or apparatus, and a recording medium for recording such a computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described in the following order:

A. First Embodiment;

B. Second Embodiment;

C. Third Embodiment; and

D. Modifications

A. First Embodiment

Figure 1:
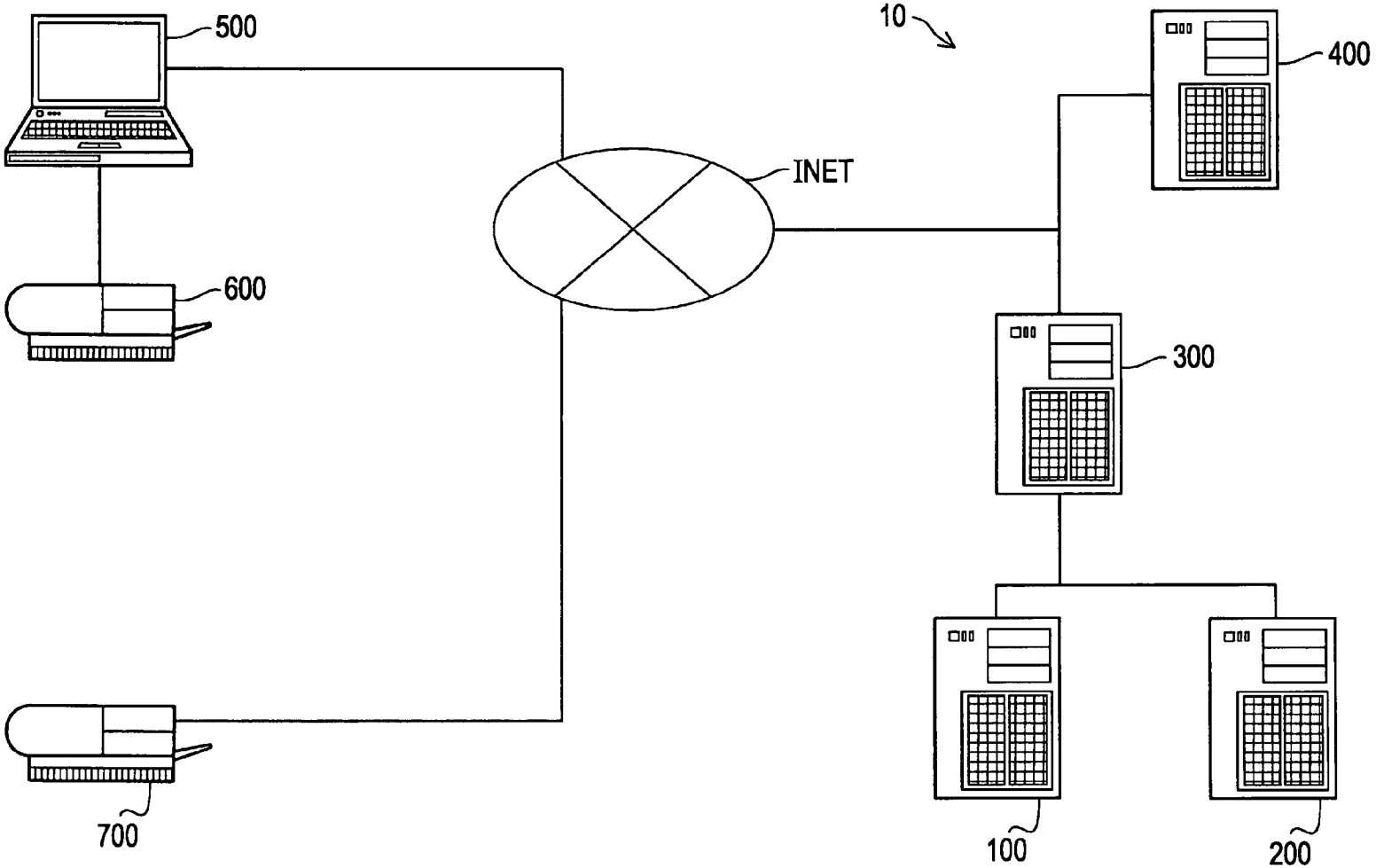
FIG. 1 is a schematic view illustrating a simplified structure of an information collection system as one embodiment of the invention.

FIG. 1 is a schematic view illustrating a simplified structure of an information collection system as one embodiment of the invention. The information collection system 10 includes an application server 100, a database server 200, a firewall 300, and a WEB server 400. The application server 100 and the database server 200 are arranged on the inside (internal network) of the firewall 300 and the securities thereof are ensured. On the other hand, the WEB server 400 is arranged on the outside (external network) of the firewall 300. An isolated network zone (DMZ) may be established between the internal network and the external network, and the WEB server 400 may be arranged on the DMZ. When the security of the WEB server 400 is considered, it may be preferable to configure the WEB server 400 to be arranged on the DMZ. Moreover, the WEB server 400 may be omitted.

The information collection system 10 also includes a client computer 500 and a network printer 700, which are clients connected thereto via the Internet INET. The client computer 500 serves as a proxy to a printer 600 without any capability of direct access to a network, and is a computer functioning as a client of the information collection system 10. The network printer 700 is a printer capable of directly accessing a network and functioning as a client of the information collection system 10. Although a plurality of such clients is connected to the information collection system 10, each client is illustrated in FIG. 1 with the number one in order to simplify the illustrations.

Figure 2:
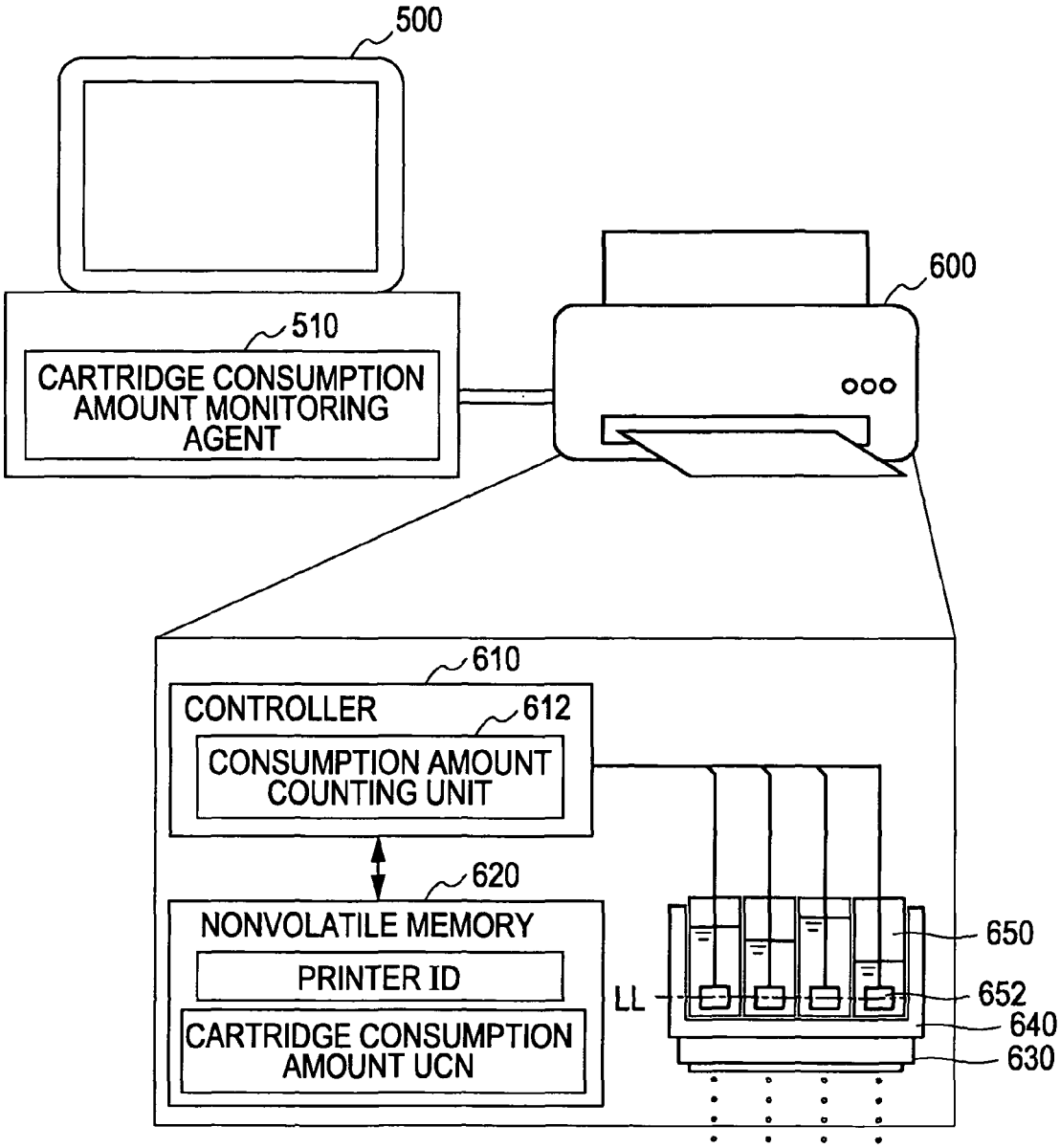
FIG. 2 is a schematic view illustrating a configuration of a client and a printer according to the first embodiment.

FIG. 2 is a schematic view illustrating a configuration of the client 500 and the printer 600 according to the first embodiment. The client 500 has a cartridge consumption amount monitoring agent 510. In the following descriptions, the cartridge consumption amount monitoring agent 510 is sometimes referred to simply as "monitoring agent 510" or "agent 510." The monitoring agent 510 has the function of monitoring a cartridge consumption amount in the printer 600. The monitoring agent 510 is preferably implemented as a resident program of the client 500. When the monitoring agent 510 is implemented as a resident program, the operation of the printer 600 can be constantly monitored, so that when the cartridge consumption amount increases, the monitoring agent 510 can be immediately informed of the increase.

The printer 600 is equipped with a controller 610, a nonvolatile memory 620, a print head 630, and a cartridge mounting portion 640. One or plural ink cartridge(s) 650 can be mounted on the cartridge mounting portion 640. Each ink cartridge 650 has a residual ink amount sensor 652. The residual ink amount sensor 652 is a sensor capable of detecting whether or not the ink amount in the ink cartridge 650 is lower than or equal to a predetermined low residual level LL. The low residual level LL is a value substantially close to zero and is preliminarily set to a low value at which it can be determined that the ink cartridge 650 is consumed. In general, when the residual ink amount decreases, a warning informing that the time for ink cartridge replacement is getting close is displayed on a user interface of the client 500 or the printer 600. The above-mentioned low residual level LL may be set to the same value as the value serving as the basis for determination as to whether the warning will be displayed or not.

The controller 610 includes a consumption amount counting unit 612. The consumption amount counting unit 612 has the function of counting the consumption amount of ink cartridges using detection results of the residual ink amount sensor 652. Description of this function will be provided later. The nonvolatile memory 620 stores therein a printer ID, which is a unique identification number of the printer 600, and the cartridge consumption amount UCN for the printer 600. Because the printer ID is a fixed value that is assigned during the manufacture of the printer, the printer ID can be stored in a non-rewritable memory area. On the other hand, because the cartridge consumption amount UCN changes during the use of the printer 600, the cartridge consumption amount UCN is stored in a rewritable nonvolatile memory (for example, EEPROM).

The monitoring agent 510 and the consumption amount counting unit 612 are respectively installed as computer programs executed by a computer. It should be noted that such functions may be implemented as hardware circuits.

Figure 3:
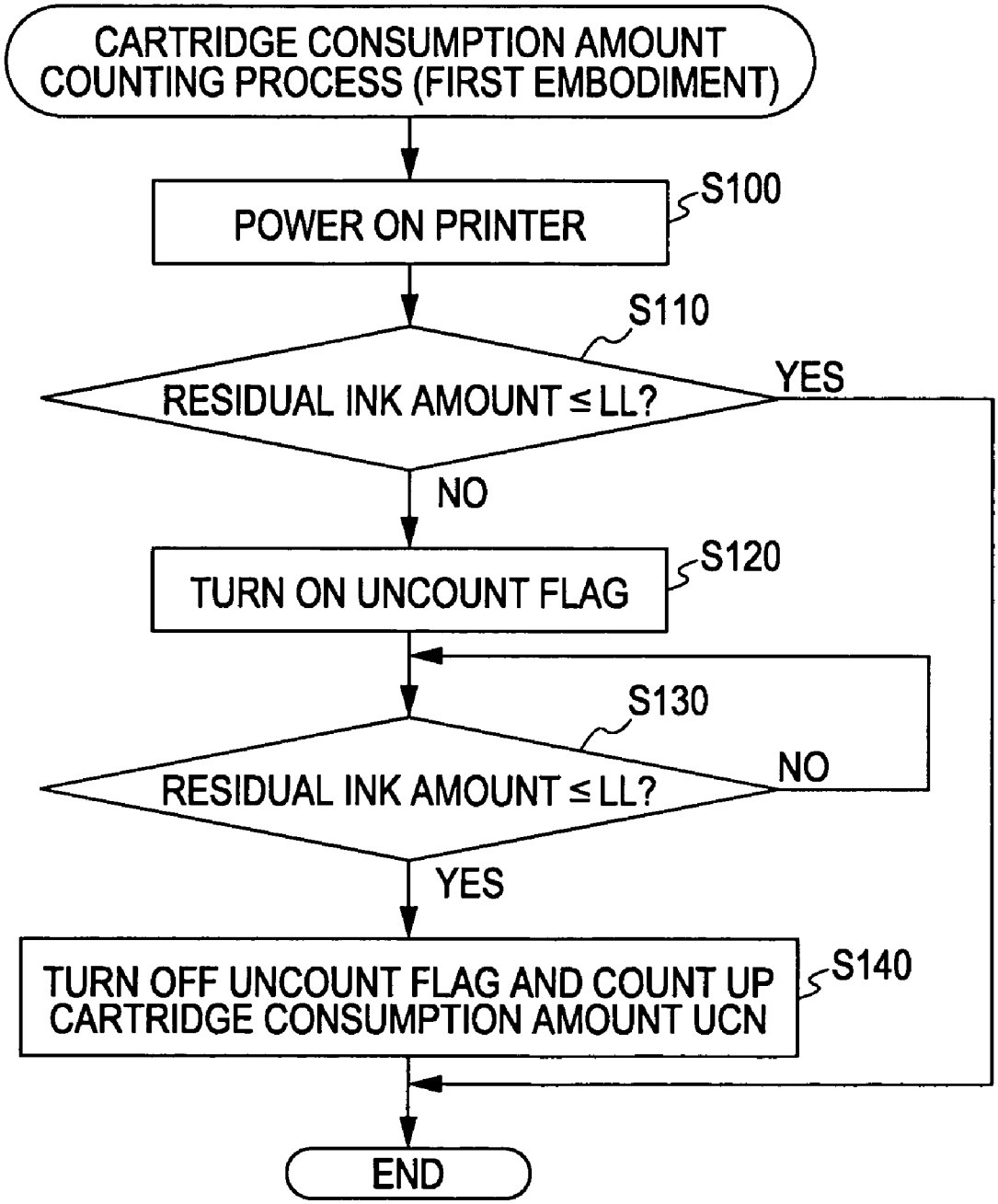
FIG. 3 is a flowchart illustrating the procedures of a cartridge consumption amount counting process according to the first embodiment.

FIG. 3 is a flowchart illustrating the procedures of a cartridge consumption amount counting process. When the printer 600 is powered ON in step S100, a determination as to whether or not the residual ink amount is lower than or equal to the low residual level LL is made in step S110 with respect to individual ink cartridges 650. This determination is executed by the consumption amount counting unit 612 based on the detection results of the residual ink amount sensor 652. When the residual ink amount in an ink cartridge is lower than or equal to the low residual level LL, the counting process for the ink cartridge ends. This is because when the residual ink amount immediately after the power-on is lower than or equal to the low residual level LL, the change wherein the residual ink amount changes from the value higher than the low residual level LL to the value lower than or equal to the low residual level LL must have occurred during a previous step. Therefore, at this point, the consumption amount of the cartridge must have already been counted.

On the other hand, when it is determined in step S110 that the residual ink amount of the ink cartridge 650 is higher than the low residual level LL, the consumption amount counting unit 612 turns ON an uncount flag for the ink cartridge 650 in step S120. The uncount flag is a flag which indicates that the consumption amount counting operation was not performed with respect to the ink cartridge 650 and which is stored in a RAM (not illustrated) of the controller 610. The uncount flag may be omitted.

In step S130, with respect to the ink cartridge 650 for which the uncount flag is ON, a determination is made as to whether or not the residual ink amount is lower than or equal to the low residual level LL. When the residual ink amount is higher than the low residual level LL, the determination of step S130 is periodically repeated. On the other hand, when the residual ink amount becomes lower than or equal to the low residual level LL, the consumption amount counting unit 612 turns OFF the uncount flag for the ink cartridge 650 and counts up, by one, the cartridge consumption amount UCN in the nonvolatile memory 620 in step S140, and the process ends. When there is another ink cartridge 650 for which the uncount flag is ON, the operations of steps S130 and S140 are executed successively.

As described above, in the procedures of FIG. 3, when a change wherein the residual ink amount of the ink cartridge 650 becomes lower than or equal to the predetermined low residual level LL is detected for the first time, the cartridge consumption amount UCN is counted up by one. If, instead of detecting such a change, the cartridge consumption amount is counted up based only on the results of the determination as to whether or not the residual ink amount of the ink cartridge 650 is lower than or equal to the predetermined low residual level LL, it is highly likely to obtain a much higher consumption amount than the number of cartridges actually consumed. This is because it cannot always be said that users replace cartridges immediately when the residual ink amount of the cartridges become lower than or equal to the low residual level; in many cases, the residual ink amount is determined to be lower than or equal to the low residual level LL when the printer 600 is powered ON. On the other hand, the change wherein the residual ink amount changes from the value higher than the low residual level LL to become lower than or equal to the low residual level LL occurs only once for each cartridge. Therefore, when the count-up is performed based on the presence of this change, it is possible to obtain a more accurate cartridge consumption amount.

The above-mentioned determination of the residual ink amount in step S110 is preferably executed at a point of time which occurs immediately after the power-on and in which ink is not ejected from the ink cartridge 650. This is because if ejection (for example, a cleaning process including ink ejection or ink suction) of ink from the print head 630 occurs during a period later than the power-on and earlier than the detection of the residual ink amount, there is a possibility that the change wherein the residual ink amount becomes lower than or equal to the low residual level LL will occur during this period.

Figure 4:
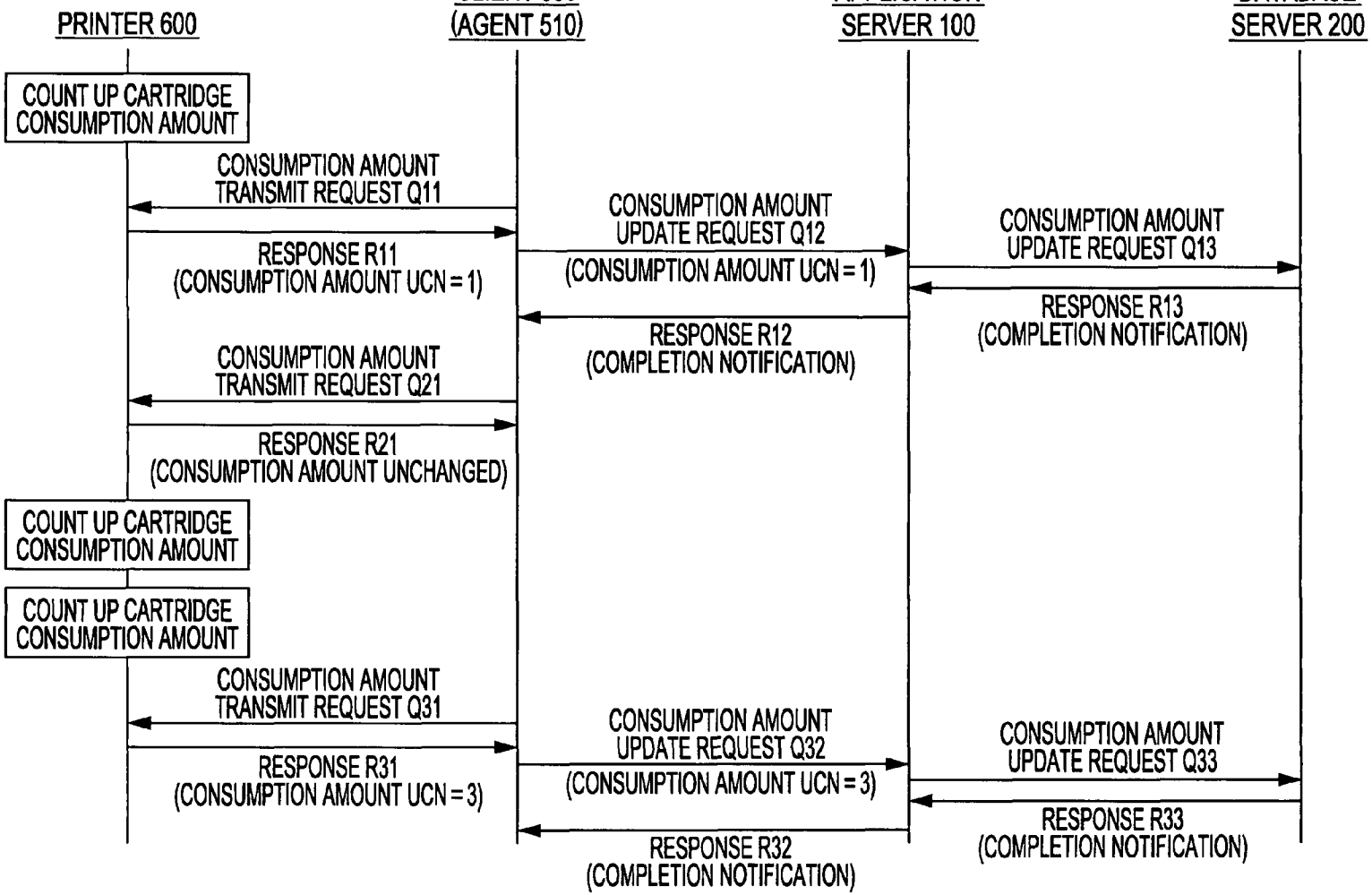
FIG. 4 is a flowchart illustrating the overall system process workflows according to the first embodiment.

FIG. 4 is a flowchart illustrating the overall system process workflows according to the first embodiment. In this example, after the printer 600 performs the cartridge consumption amount count-up operation according to the procedures of FIG. 3, a cartridge consumption amount transmit request Q11 is issued from the monitoring agent 510 of the client 500 to the printer 600. The consumption amount counting unit 612 (FIG. 2) of the printer 600 reads the cartridge consumption amount UCN from the nonvolatile memory 620 in response to the request Q11 and returns a response R11 including the cartridge consumption amount UCN (=1) to the client 500. The response R11 may preferably further include the printer ID (FIG. 2).

Upon receiving the cartridge consumption amount UCN and the printer ID, the monitoring agent 510 of the client 500 transmits an update request Q12 including the cartridge consumption amount UCN and the printer ID to the application server 100. The application server 100 transmits the same update request Q13 as the update request Q12 to the database server 200. In response to this request Q13, the database server 200 updates a cartridge consumption amount field which is registered for each printer ID. In the present embodiment, the cartridge consumption amount UCN (FIG. 2) stored in the printer 600 is an accumulative cartridge consumption amount of the printer 600. Therefore, by registering the cartridge consumption amount UCN per se on a database, the accumulative cartridge consumption amount of the printer 600 can be stored for each printer ID.

When the update request Q13 is appropriately processed in the database server 200, a response R13 (completion notification) is sent back to the application server 100 and a response R12 (completion notification) is sent back from the application server 100 to the client 500.

In the example of FIG. 4, after this, although the client 500 issues the next transmit request Q21, the cartridge consumption amount UCN was not counted up after the previous transmit request Q11 was issued. Therefore, the printer 600 responds by sending back a response R21 indicating that the consumption amount is unchanged.

Furthermore, in the example of FIG. 4, after this, the cartridge consumption amount UCN is counted up twice in succession and then a cartridge consumption amount UCN transmit request Q31 is issued from the client 500. At this point in time, since the cartridge consumption amount UCN in the printer 600 is equal to 3, this value is sent back to the client 500 as a response R31. After this, similar to the above-mentioned procedures, update requests Q32 and Q33 for the cartridge consumption amount UCN (=3) are sequentially issued and processed, and corresponding responses R32 and R33 are sent back.

As described above, in the first embodiment, the accumulative consumption amount UCN of cartridges is stored in the nonvolatile memory 620 of the printer 600, and in response to requests, the accumulative consumption amount UCN is transmitted to the external device (the client 500, the application server 100, or the database server 200). The external device can be constantly informed of the correct accumulative consumption amount.

The accumulative consumption amount registered on the database can be utilized for a variety of purposes. For example, the accumulative consumption amount may be used to predict or diagnose printer failures or to advise users to have the printer checked. In some cases, depending on the accumulative consumption amount, a discount coupon for products of the printer's manufacturer may be presented to users.

B. Second Embodiment

Figure 5:
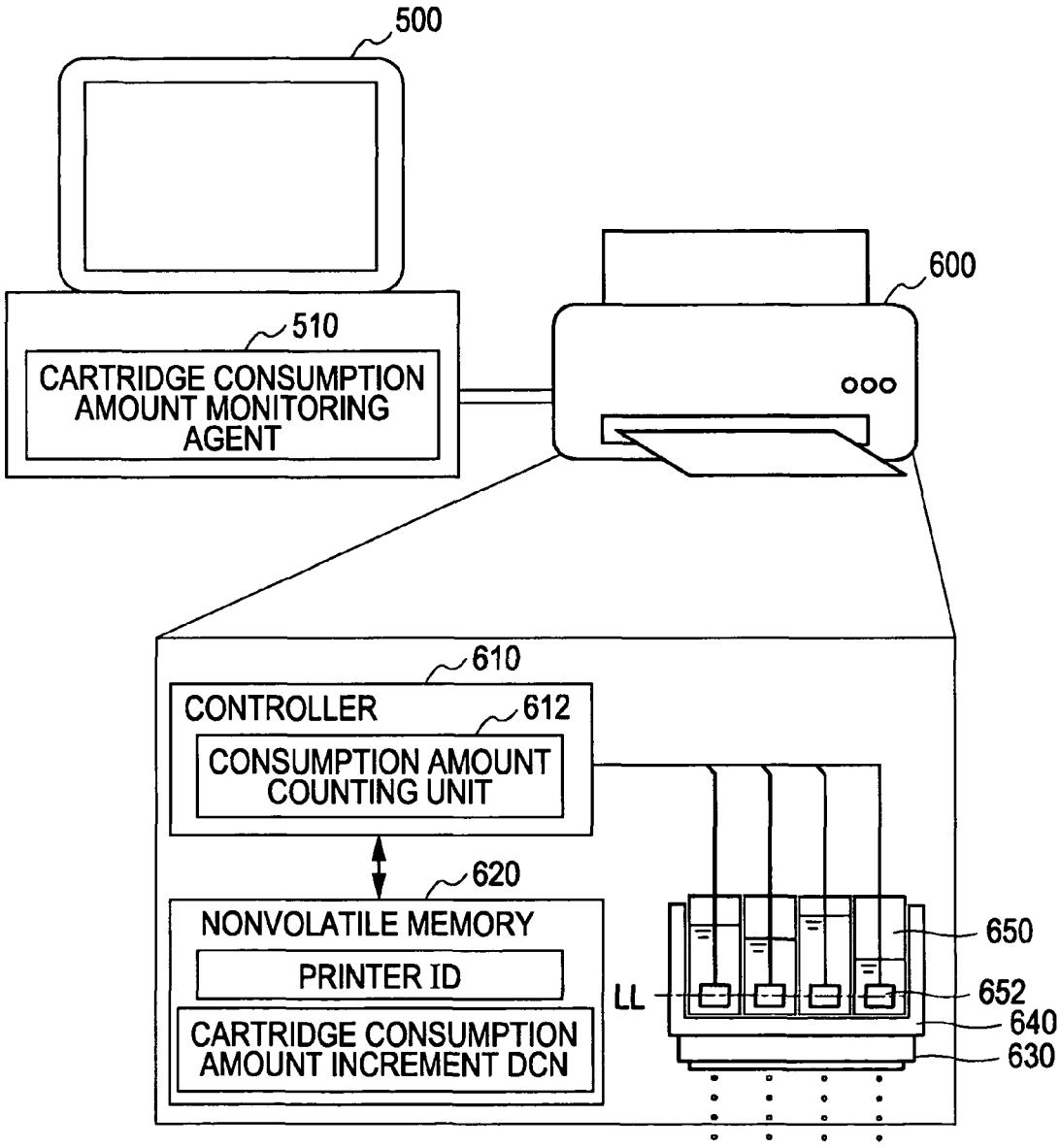
FIG. 5 is a schematic view illustrating a configuration of a client and a printer according to a second embodiment.

FIG. 5 is a schematic view illustrating a configuration of a client 500 and a printer 600 according to a second embodiment. The second embodiment differs from the first embodiment in that a cartridge consumption amount increment DCN is stored in the nonvolatile memory 620 for the present embodiment in lieu of the cartridge consumption amount UCN. The other configurations are identical to those of the first embodiment. The cartridge consumption amount increment DCN is the increment in the cartridge consumption amount which occurs after the client 500 has reported information on the expendables to the application server 100. Therefore, whenever the client 500 reports the increment DCN to the application server 100, the value of the increment DCN is initialized to 0.

The cartridge consumption amount counting process according to the second embodiment is identical to the process (FIG. 3) according to the first embodiment, except that the cartridge consumption amount increment DCN is counted up for the present embodiment in lieu of the cartridge consumption amount UCN; therefore, detailed description thereof will be omitted.

Figure 6:
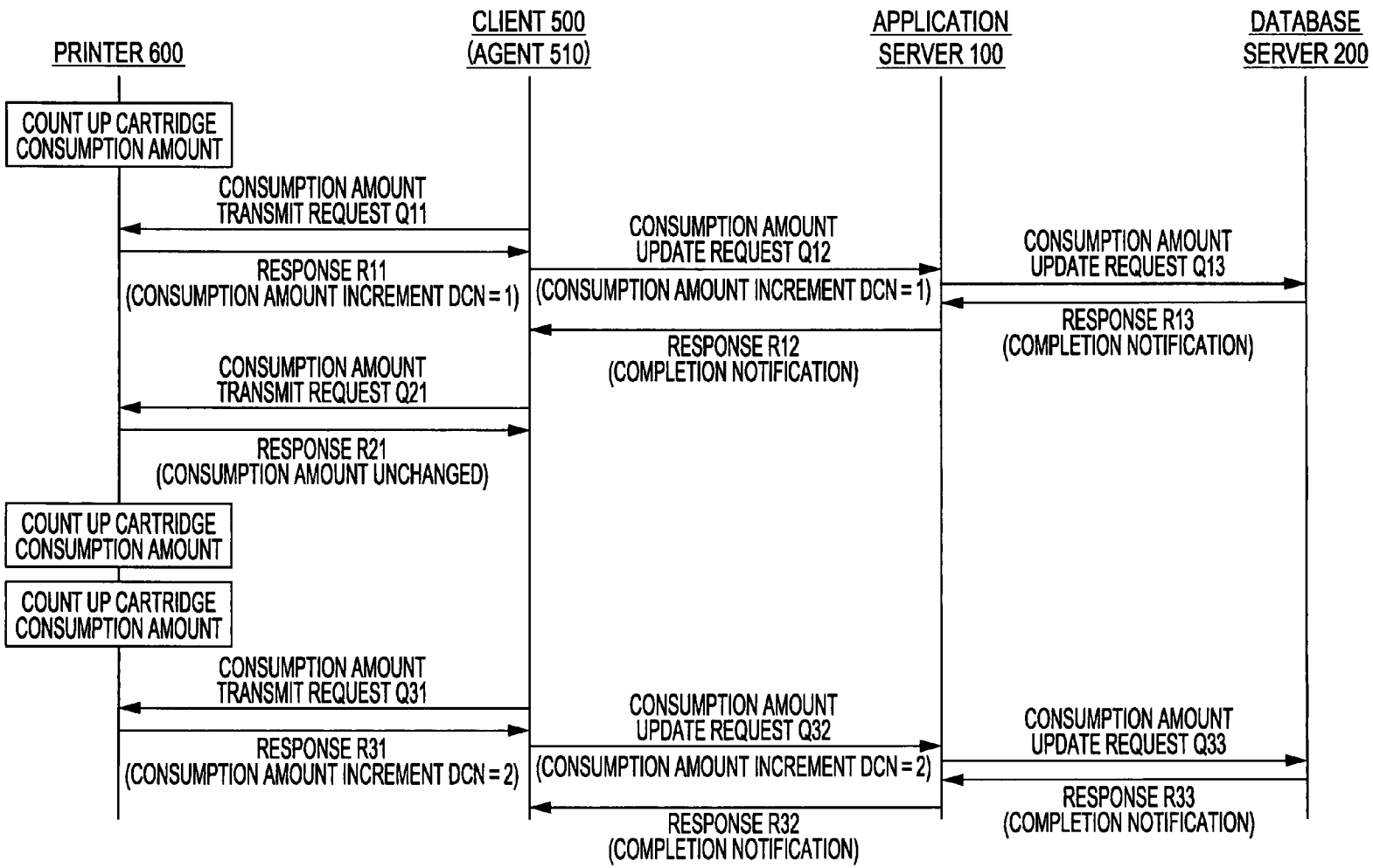
FIG. 6 is a flowchart illustrating the overall system process workflows according to the second embodiment.

FIG. 6 is a flowchart illustrating the overall system process workflows according to the second embodiment. This process differs from that of the first embodiment illustrated in FIG. 4, in that the response R11 sent from the printer 600 to the client 500 and the update requests Q12 and Q13 which are issued according to the response R11 include the cartridge consumption amount increment DCN in lieu of the cartridge consumption amount UCN. The same statements can be applied to the response R31 and the update requests Q32 and Q33. Upon receiving the cartridge consumption amount increment DCN, the database server 200 adds the value thereof to the value of the cartridge consumption amount field registered for each printer ID. Therefore, similar to the first embodiment, the value of the cartridge consumption amount field on the database becomes a value that represents the accumulative cartridge consumption amount for each printer.

As described above, even when the cartridge consumption amount increment DCN is transmitted from the printer to the external device as the information on the expendables in lieu of the cartridge consumption amount UCN, it is possible to register the correct accumulative cartridge consumption amount on the database. The accumulative cartridge consumption amount may be registered on an external device (for example, the client 500) other than the database.

C. Third Embodiment

Figure 7:
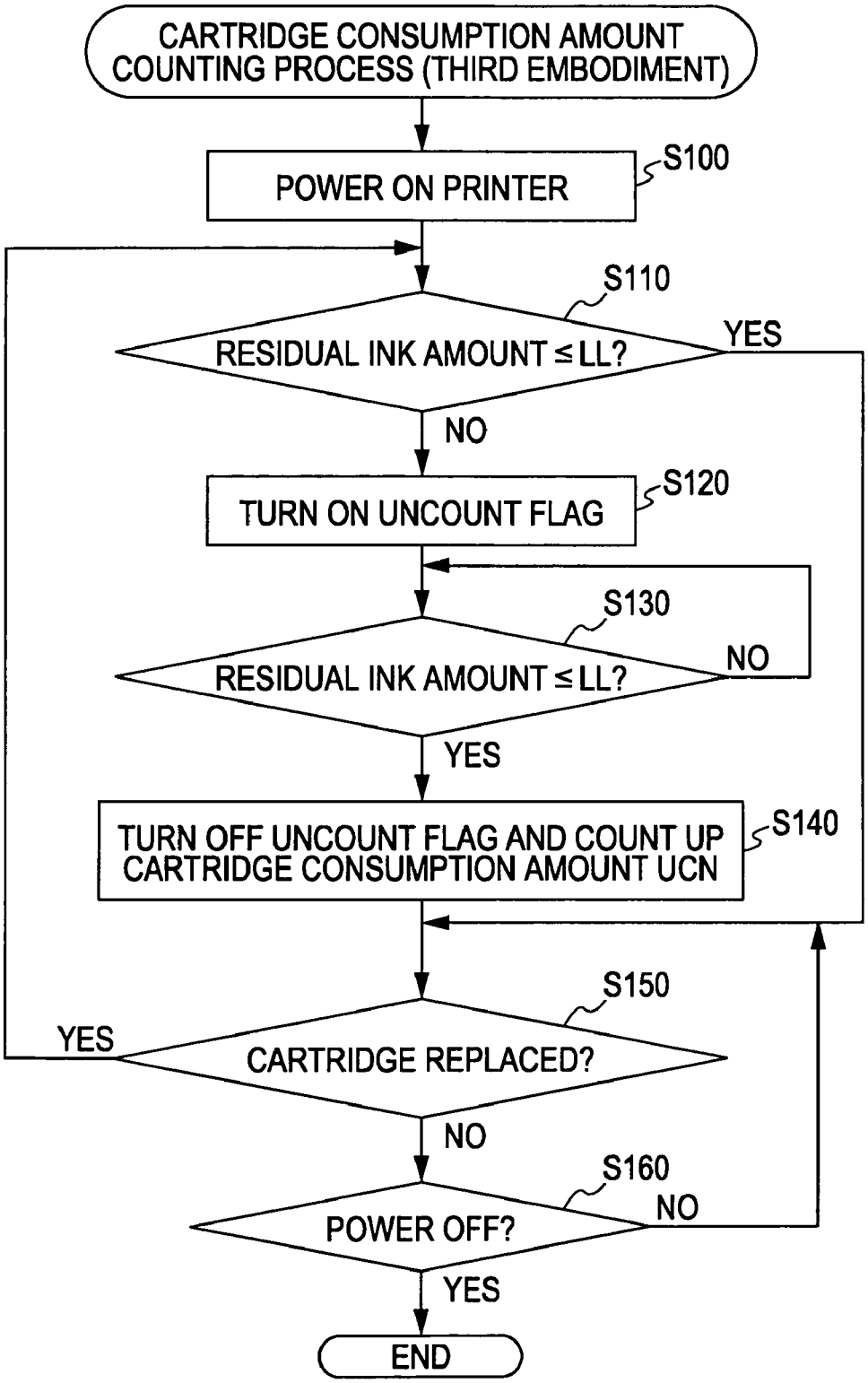
FIG. 7 is a flowchart illustrating the procedures of a cartridge consumption amount counting process according to a third embodiment.

FIG. 7 is a flowchart illustrating the procedures of a cartridge consumption amount counting process according to a third embodiment. In the procedures of FIG. 7, steps S150 and S160 are added at the end of the procedures of FIG. 3.

In step S150, a determination is made as to whether or not a cartridge for which the cartridge consumption amount was counted up has been replaced. This determination can be executed by the controller 610 (FIG. 2) by using an insertion detecting terminal (not illustrated) formed in the ink cartridge 650. If the cartridge was not replaced, the replacement of the cartridge is monitored until the printer 600 is powered OFF (steps S150 and S160).

On the other hand, if the cartridge was replaced, the flow returns to step S110 and the operations of steps S110 to S140 described with respect to the first embodiment are executed. At this time, when the residual ink amount of the cartridge immediately after the replacement is lower than or equal to the low residual level LL, the process proceeds directly from step S110 to step S150. Therefore, when a cartridge having a low residual ink amount is mounted on the cartridge mounting portion 640 during cartridge replacement, the cartridge consumption amount counting operation is not performed with respect to the cartridge. On the other hand, when a cartridge of which the residual ink amount is higher than the low residual level LL is mounted on the cartridge mounting portion 640, the cartridge consumption amount counting operation is performed with respect to the cartridge.

As described above, in the third embodiment, when a cartridge is replaced, the cartridge consumption amount counting process is executed with respect to the cartridge only when the residual ink amount of the ink cartridge after the replacement is higher than the low residual level LL. Therefore, it is possible to prevent the cartridge consumption amount from being erroneously counted up even when a cartridge having a low residual ink amount is mounted.

D. Modifications

The invention is not limited to the above embodiments and their applications and can be implemented in a variety of ways without departing from the scope or spirit of the invention. For example, the following modifications are possible.

D1. Modification 1

In the above-described embodiments, the detection as to whether or not the residual ink amount of cartridges is lower than or equal to the low residual level LL was made based only on the detection results of the residual ink amount sensor 652. The detection as to whether or not the residual ink amount is lower than or equal to the low residual level LL may instead be made based on an ink consumption amount (ink ejection amount) during printing as well as the detection results of the residual ink amount sensor 652. Both of these methods have something in common in that both methods use the detection results of the residual ink amount sensor 652 to make the determination as to whether or not the residual ink amount is lower than or equal to the low residual level LL.

D2. Modification 2

In the above-described embodiments, when the change wherein the residual ink amount becomes lower than or equal to the low residual level LL is detected for the first time, the cartridge consumption amount UCN was counted up by 1. However, the amount of the count-up is not limited to 1, and the amount may be counted up with a predetermined step width. For example, a case may be considered where the printer 600 is able to mount thereon a cartridge having a normal ink capacity and a cartridge having an ink capacity larger by N times (N is an integer larger than or equal to 2) than the normal one. In such a case, when the cartridge having the N-times larger capacity is consumed, it is preferable to count up the cartridge consumption amount by N. However, the step width used during the count-up may be preset in consideration of other factors without being limited to the ink capacity.

D3. Modification 3

In the above-described embodiments, the uncount flag (a flag indicating that the consumption amount counting operation was not performed with respect to the cartridge) was stored in the RAM of the controller 610 of the printer 600. The uncount flag may instead be stored in a nonvolatile memory mounted on each cartridge 650. In the latter case, even after the printer is powered OFF once, when the residual ink amount of the cartridge 650 becomes lower than or equal to the low residual level LL during the subsequent operation of the printer, it is possible to count up the cartridge consumption amount. Moreover, in this case, it is not necessary to check the residual ink amount immediately after the power-on of the printer, but the residual ink amount may be checked at an arbitrary time point.

D4. Modification 4

In the above-described embodiments, although the technique described is for counting the consumption amount of ink cartridges, the invention can be applied to a technique for counting the consumption amount of expendable cartridges other than ink cartridges. For example, with respect to various expendable cartridges such as toner cartridges, photographic paper cartridges or film cartridges, the consumption amount thereof can be counted in a manner similar to that of the above-described embodiments. The ink cartridges and the toner cartridges can sometimes be referred to as "colorant cartridges." Moreover, the invention can be applied to various apparatuses other than printers, such as processing apparatuses or electronic apparatuses.

What is claimed is:

1. An apparatus capable of mounting an expendable cartridge thereon, comprising:

a consumption amount counting unit that counts up the consumption amount of ink in expendable cartridges in the apparatus when a change is detected for the first time during the continuous operation of the apparatus, the change being a residual expendable amount of the expendable cartridge decreasing from a value higher than a predetermined low residual level to a value lower than or equal to the low residual level, wherein:

the consumption amount of ink in the expendable cartridges is counted up, and with respect to the respective expendable cartridges mounted on the apparatus, (a1) it is detected whether or not the residual expendable amount is lower than or equal to the low residual level immediately after the apparatus is powered on;

(a2) the count-up is not performed with respect to an expendable cartridge of which the residual expendable amount is lower than or equal to the low residual level immediately after the power-on;

(b1) when any expendable cartridge is replaced, it is detected whether or not the residual expendable amount is lower than or equal to the low residual level immediately after the replacement; and (b2) when any expendable cartridge is replaced and the residual expendable amount immediately after the replacement is lower than or equal to the low residual level, the count-up is not performed with respect to the replaced expendable cartridge.

2. The apparatus according to claim 1, wherein when any expendable cartridge is replaced during the continuous operation of the apparatus, the consumption amount counting unit performs as follows:

(b1) detects whether or not the residual expendable amount is lower than or equal to the low residual level immediately after the replacement; and (b2) does not perform the count-up with respect to the replaced expendable cartridge when the residual expendable amount immediately after the replacement is lower than or equal to the low residual level.

3. The apparatus according to claim 1, wherein the expendable cartridge incorporates therein a sensor capable of detecting the residual expendable amount, and wherein the consumption amount counting unit detects the change using the sensor.

4. The apparatus according to claim 1, further comprising a nonvolatile memory for storing information on the consumption amount of ink in the expendable cartridges in the apparatus, wherein the nonvolatile memory stores an accumulative consumption amount of ink in the expendable cartridges in the apparatus.

5. The apparatus according to claim 1, further comprising a nonvolatile memory for storing information on the consumption amount of ink in the expendable cartridges in the apparatus, wherein the expendable counting unit has a function of reading the information on the consumption amount from the nonvolatile memory to report the information to an external device, and wherein the nonvolatile memory stores, as the consumption amount information, the increment in the consumption amount of ink in the expendable cartridges from the point in time when the previous report was sent to the external device.

6. A method for counting the consumption amount of ink in expendable cartridges in an apparatus capable of mounting the expendable cartridges thereon, comprising:

a step of counting up the consumption amount of ink in expendable cartridges in the apparatus when a change is detected for the first time during the continuous operation of the apparatus, the change being a residual expendable amount of the expendable cartridge decreasing from a value higher than a predetermined low residual level to a value lower than or equal to the low residual level, wherein:

in the count-up step, the consumption amount of ink in the expendable cartridges is counted up, and with respect to the respective expendable cartridges mounted on the apparatus;

(a1) it is detected whether or not the residual expendable amount is lower than or equal to the low residual level immediately after the apparatus is powered on;

(a2) the count-up is not performed with respect to an expendable cartridge of which the residual expendable amount is lower than or equal to the low residual level immediately after the power-on;

(b1) when any expendable cartridge is replaced, it is detected whether or not the residual expendable amount is lower than or equal to the low residual level immediately after the replacement; and (b2) when any expendable cartridge is replaced and the residual expendable amount immediately after the replacement is lower than or equal to the low residual level, the count-up is not performed with respect to the replaced expendable cartridge.

* * * * *